US007181814B1

(12) United States Patent
Palmer

(10) Patent No.: US 7,181,814 B1
(45) Date of Patent: Feb. 27, 2007

(54) BURIAL CASKET WITH WEDGE BAR LOCK

(75) Inventor: Dale Palmer, Richmond, IN (US)

(73) Assignee: Matthews Resources, Inc., Wilmington, DE (US)

( * ) Notice: Subject to any disclaimer, the term of this patent is extended or adjusted under 35 U.S.C. 154(b) by 0 days.

(21) Appl. No.: 11/273,046

(22) Filed: Nov. 14, 2005

(51) Int. Cl.
*A61G 17/00* (2006.01)

(52) U.S. Cl. ..... 27/17; 27/2; 27/DIG. 1; 292/157; 292/160; 292/DIG. 53

(58) Field of Classification Search ..... 27/2, 27/17, DIG. 1; 292/160, 161, 162, 157, 292/DIG. 53, 145
See application file for complete search history.

(56) References Cited

U.S. PATENT DOCUMENTS

| | | | | |
|---|---|---|---|---|
| 1,754,045 A | | 4/1930 | Powell | |
| 2,323,674 A | | 7/1943 | Purkiss | |
| 2,723,147 A | * | 11/1955 | Slaughter, Jr. et al. | 292/302 |
| 2,864,640 A | * | 12/1958 | Mattinson | 292/335 |
| 2,929,128 A | | 3/1960 | White | |
| 3,403,432 A | * | 10/1968 | Bencene | 27/17 |
| 3,845,976 A | | 11/1974 | Peterson | |
| 4,486,040 A | * | 12/1984 | Strangward | 292/160 |
| 5,265,923 A | | 11/1993 | Paddock | |
| 5,503,439 A | | 4/1996 | LaJeunesse et al. | |
| 6,154,938 A | | 12/2000 | LaJeunesse et al. | |
| 7,014,227 B2 | * | 3/2006 | Strangward et al. | 292/160 |

* cited by examiner

*Primary Examiner*—William L. Miller
(74) *Attorney, Agent, or Firm*—Schweitzer Cornman Gross & Bondell LLP

(57) ABSTRACT

A burial casket has a base portion with a plurality of locking element openings and a top having a plurality of locking elements depending downwardly. A hanger-supporting member is affixed to a lower surface of the top rim of said base, and has a plurality of locking element openings aligned with the locking element openings. Opposed flanges of hangers are disposed in recesses of the hangar-supporting member. A locking bar extends through the hangers. When the top is closed, each locking element extends through one of the locking element openings and through one of the aligned locking element openings. The locking bar engages the plurality of locking elements to restrain the top in closed position. A decorative material-supporting member depends downwardly from the hanger-supporting member.

11 Claims, 6 Drawing Sheets

BURIAL CASKET WITH WEDGE BAR LOCK

FIELD OF THE INVENTION

The invention pertains to the field of burial caskets, and in particular to burial caskets with wedge bar locks.

BACKGROUND OF THE INVENTION

As is known, burial caskets may have hinged tops sealed to a body portion of the casket by a plurality of locking projections that extend downwardly from a front portion of a lower rim of the top. When the top is in a closed position, the locking projections extend through associated openings in a front portion of an upper rim of a base of the casket, and are engaged by a locking bar.

The locking bar is located below the upper rim of the base, within a cavity of the base. The locking bar moves horizontally and includes a plurality of locking projection catches with cam surfaces that engage the locking projections pulling the top downwardly into a sealed, locked position. Preferably, the top and/or base include elastomeric seals along the rims thereof, which seals are compressed during locking.

The casket may also include an elongated J-shaped channel extending substantially along the entire length of the front portion of the upper rim of the base, which J-shaped channel provides a means for affixing decorative material to the interior of the casket. The J-shaped channel has an elongated hanger-supporting member affixed to the lower surface of the upper rim of the base. The J-shaped channel also includes a decorative material-supporting portion depending downwardly from the hanger-supporting member.

An elongated U-shaped portion is affixed to the decorative material-supporting portion and includes an opening in the interior of the casket for supporting fastening material, such as paper or cardboard, or the like, suitable for the attachment and support of decorative material thereto, such as by staples, nails, tacks, or the like.

The hanger-supporting member includes a plurality of openings aligned with the openings in the upper rim of the base to permit the locking projections to pass therethrough.

The locking bar is suspended within the cavity by a plurality of hangers spaced at intervals along the length thereof. Each hanger includes a downwardly-depending U-shaped portion and a pair of opposed, horizontal flanges extending outwardly from upper ends of the U-shaped portion.

The horizontal flanges of each hanger are fixedly connected to a lower surface of the hanger-supporting member by spot welding, such that the hanger-supporting member is disposed intermediate the lower surface of the upper rim of the base and the opposed, horizontal flanges of the hangers.

Fasteners, such as screws or bolts, or the like, are directed through the upper rim of the base into the hanger-supporting member to affix the hanger-supporting member underneath the upper rim of the base. This construction requires the hangers to be affixed to the hanger-supporting member prior to mounting the hanger-supporting member to the base and may produce unreliable results. The present invention improves upon this construction, as is described in detail below.

The locking bar is moved horizontally between unlocked and locked positions by manual or powered rotation of a screw mechanism accessible from an exterior of the casket. The screw mechanism is rotated by a removable crank that engages a socket in an exposed end of the screw mechanism. The screw mechanism of the present invention also improves upon this construction, as described below.

SUMMARY OF THE INVENTION

A burial casket constructed according to the present invention includes a base and a top hingedly connected to the base. The top includes a plurality of locking projections extending (downwardly) for locking and sealing the top to the base. When the top is in a closed position, the locking projections extend through associated locking element openings in the base, and are engaged by a locking bar.

The locking bar is located below an upper rim of the base, within a cavity therein. The locking bar moves horizontally and includes a plurality of locking projection catches with cam surfaces that engage the locking projections to pull the top downwardly into a sealed, locked position.

The casket includes an elongated J-shaped channel which provides a means for supporting the locking bar and for affixing decorative material to an interior of the casket. The J-shaped channel has a hanger-supporting member which includes a plurality of locking element openings aligned with associated locking element openings in the upper rim of the base to permit the locking projections to pass therethrough.

The locking bar is suspended within the cavity by a plurality of hangers spaced at intervals along the length thereof. Each hanger includes an upright, U-shaped lower portion depending downwardly from a top portion. Each top portion includes a pair of opposed flanges.

The hanger-supporting member includes a plurality of downwardly-depressed hanger recesses, and includes a hanger opening associated with each hanger recess. Each hanger recess is preferably sized and shaped to closely receive a top portion of a hanger, with a lower portion of the hanger extending through an associated hanger opening.

The hanger-supporting member is preferably affixed to the lower surface of the upper rim of the base by a plurality of mechanical fasteners, such as screws, bolts, or the like, with each fastener being directed through and engaging the upper rim, the top portion of an associated hanger and the hanger-supporting member.

The locking bar is directed through and suspended by the lower portions of the hangers below the hanger-supporting member and is moved horizontally, between an unlocked and the locked position by an articulation mechanism accessible from an exterior of the casket at a first end of the base.

Preferably, the locking bar articulation mechanism includes a screw having a shaft, a threaded portion and an axial constraint. The articulation mechanism also includes a collar fixed relative to the base, which collar engages the axial constraint of the screw.

A threaded nut is disposed over the threaded portion of the screw and the locking bar includes a nut-engaging portion which substantially prevents rotation of the nut relative to the screw such that rotation of the screw results in axial translation of the nut relative to the screw. The nut-engaging portion also substantially prevents axial translation of the nut relative to the locking bar such that axial translation of the nut, relative to the screw, results in a substantially equal axial translation of the locking bar.

During retraction of the locking bar, the locking bar moves toward the first end of the base. The locking bar has a retracted position wherein a retraction stop of the locking bar engages a free-end portion of the threaded portion of the screw to prevent further retraction of the locking bar. Preferably, when the locking bar is in the retracted position, the retraction stop abuts an end face of the free-end portion of the screw and the retraction stop partially encircles the free-end of the screw on at least three sides thereof, such as the end face and opposed lateral sides of the free-end portion. Thus, the free-end portion of the screw is reliably trapped within the retraction stop when the locking bar is in the retracted position.

During extension of the locking bar, the locking bar moves away from the first end of the base. The locking bar has an extended position wherein an extension stop fixed relative to the base engages the locking bar to prevent further extension of the locking bar. Preferably, the extension stop includes a pair of extension stop flanges affixed to and depending downwardly from the bracket.

The locking bar includes an integral or substantially integral loop, which loop encircles the nut and the free-end portion of the screw. The loop includes a screw opening through which the screw extends. The screw opening is sized and shaped to permit free, non-engaging passage of the threaded portion of the screw therethrough. Specifically, the screw opening is preferably circular with a radius greater than a maximum radius of the threaded portion of the screw.

Preferably, the loop is formed by mechanical deformation of the integral length of elongated material, with a free end thereof welded, or otherwise rigidly affixed to an elongated base portion of the locking bar.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE PREFERRED EMBODIMENTS

Figure 1:
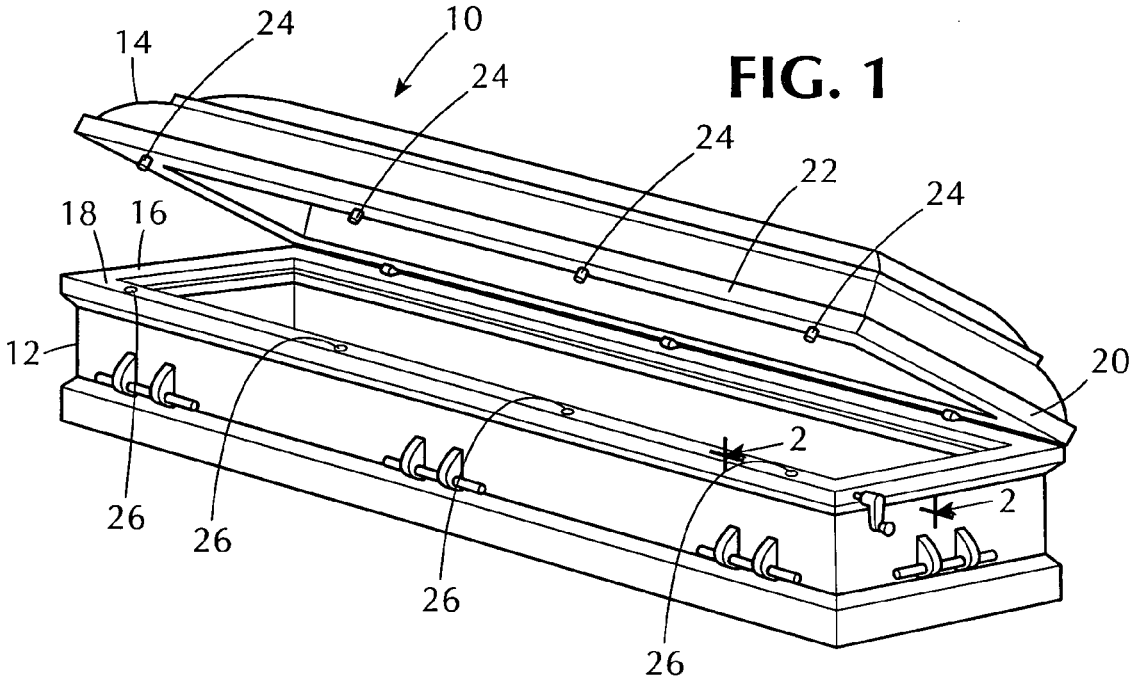
FIG. 1 is a perspective view, from the front, of a burial casket constructed according to the invention.
Figure 4:
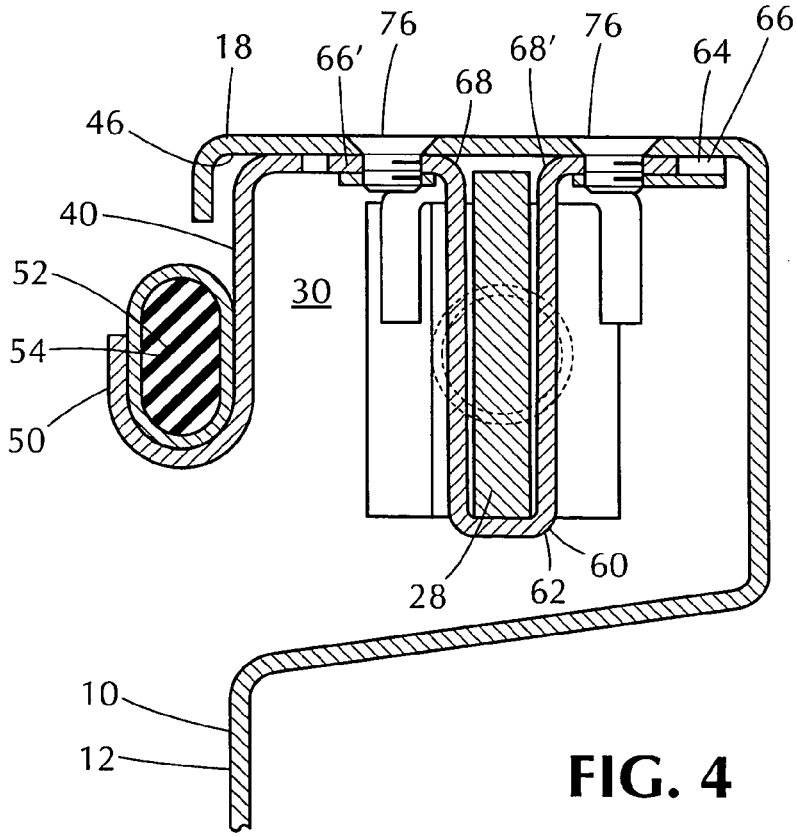
FIG. 4 is an end elevation view, taken along line 4—4 of FIG. 3.
Figure 2:
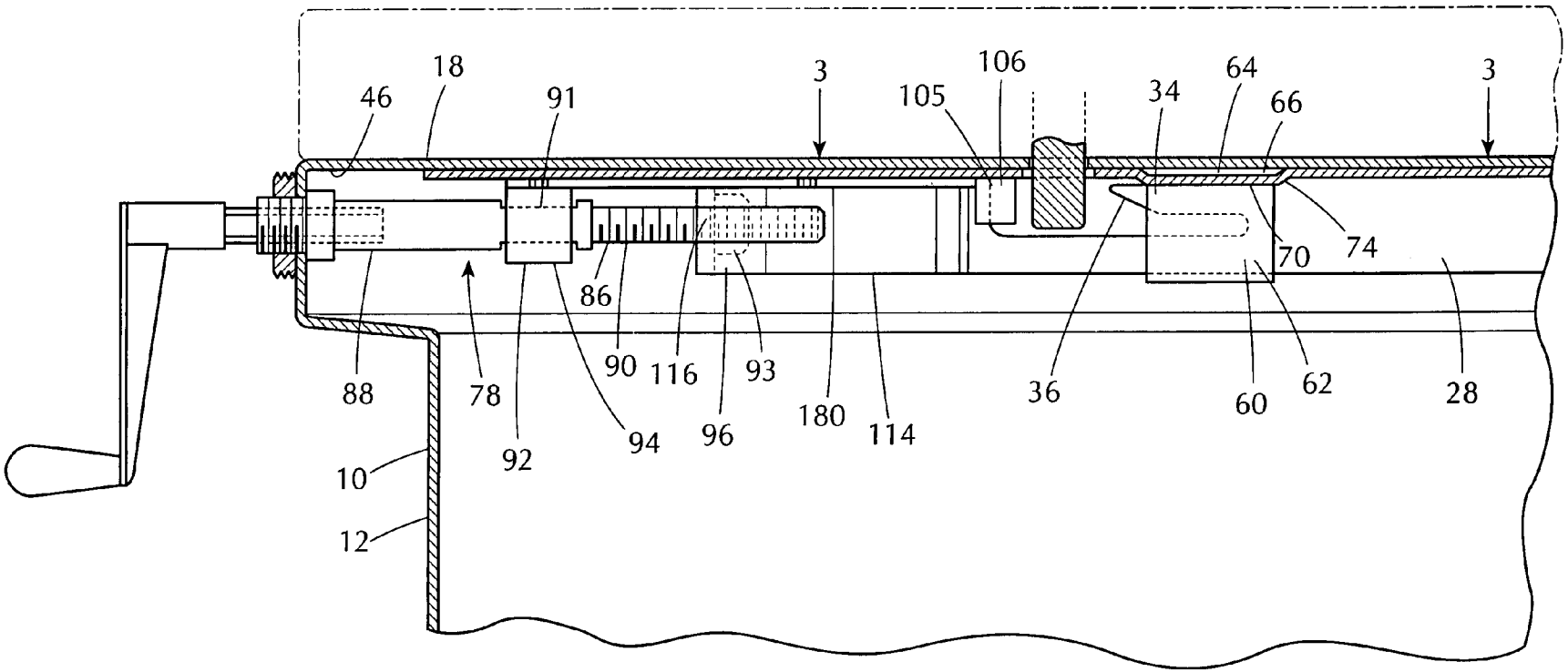
FIG. 2 is a side elevation view taken along line 2—2 of FIG. 1.
Figure 3:
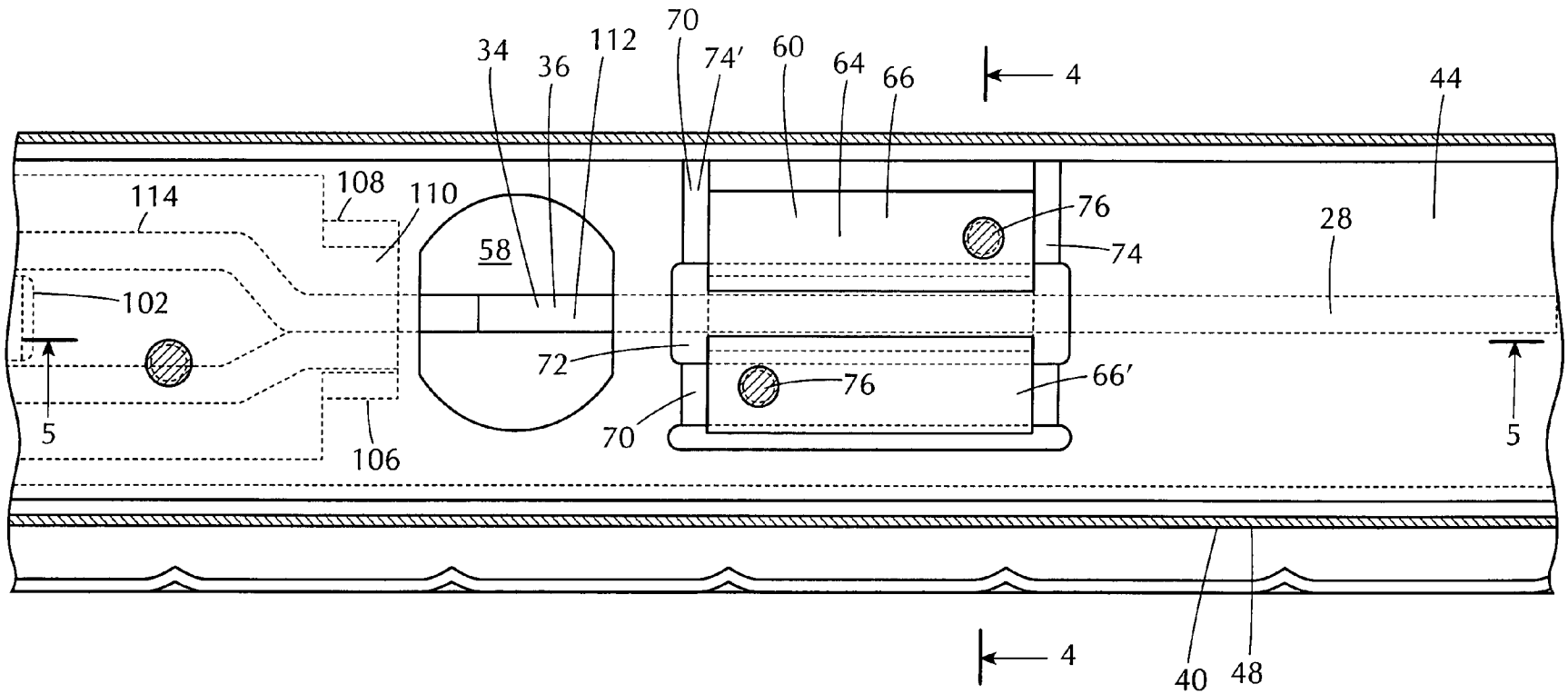
FIG. 3 is a top plan view, taken along line 3—3 of FIG. 2.
Figure 5:
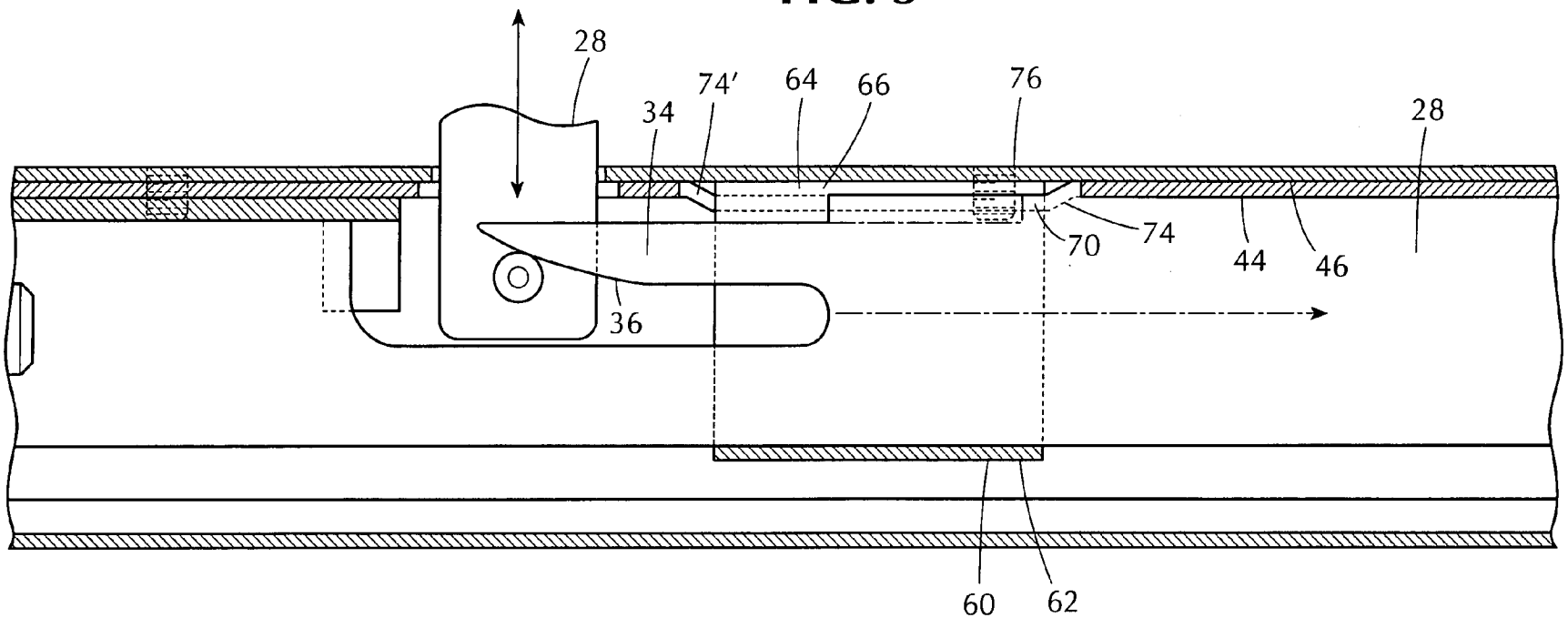
FIG. 5 is a side elevation view, taken along line 5—5 of FIG. 3.
Figure 6:
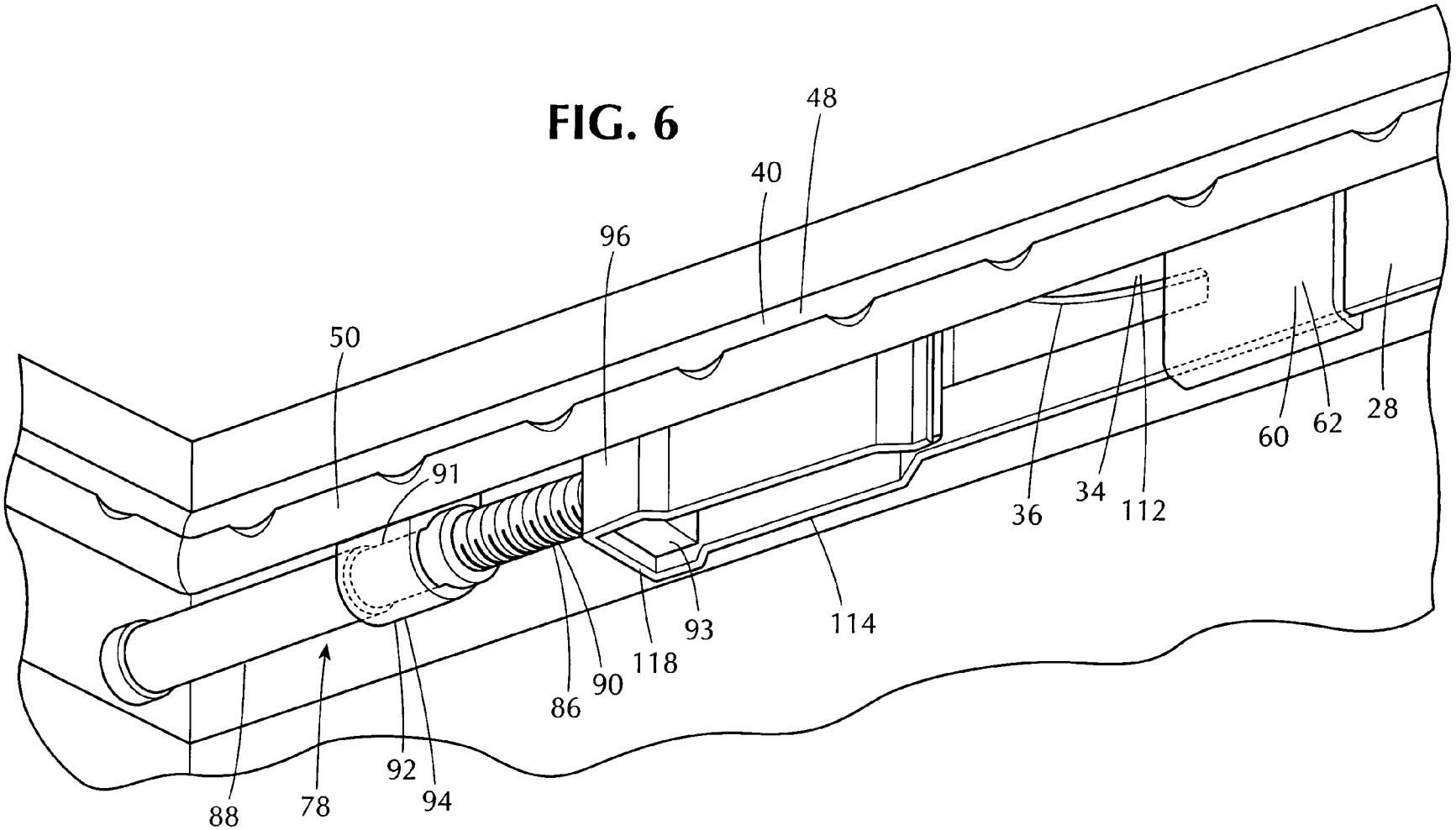
FIGS. 6 and 7 are perspective views of the articulation mechanism.

Referring to FIGS. 1–6, a burial casket 10 constructed according to the present invention includes a base 12 and a top 14 hingedly connected to the base 12. The base 12 includes an upper rim 16 having a front portion 18 and the top 14 includes a lower rim 20 having a front portion 22.

The top 14 includes a plurality of locking projections 24 extending (downwardly) from the front portion 22 of the lower rim 20 for locking and sealing the top 14 to the base 12. When the top 14 is in a closed position, the locking projections 24 extend through associated locking element openings 26 in the front portion 18 of the upper rim 16 of the base 12, and are engaged by a locking bar 28.

The locking bar 28 is located below the upper rim 16 of the base 12, within a cavity 30 therein. The locking bar 28 moves horizontally and includes a plurality of locking projection catches 34 with cam surfaces 36 that engage the locking projections 24 to pull the top 14 downwardly into a sealed, locked position. Preferably, the base 12 and/or top 14 include an elastomeric seal (not shown) along the rim 16/20 thereof, which seal is compressed during locking.

The casket 10 also includes an elongated J-shaped channel 40 extending substantially along the entire length of the front portion 18 of the upper rim 16 of the base 12, which J-shaped channel 40 provides a means for supporting the locking bar 28 and for affixing decorative material (not shown) to an interior of the casket 10. The J-shaped channel 40 has an elongated hanger-supporting member 44 affixed to a lower surface 46 of the upper rim 16 of the base 12. The J-shaped channel 40 also includes a decorative material-supporting portion 48 depending downwardly from the hanger-supporting member 44.

An elongated U-shaped portion 50 is affixed to the decorative material-supporting portion 48 and includes an opening 52 in the interior of the casket 10 for supporting elongated fastening material 54, such as paper or cardboard, or the like, suitable for the attachment and support of decorative material (not shown) thereto, such as by staples, nails, tacks, or the like.

The hanger-supporting member 44 includes a plurality of locking element openings 58 aligned with associated locking element openings 26 in the upper rim 16 of the base 12 to permit the locking projections 24 to pass therethrough.

The locking bar 28 is suspended within the cavity 30 by a plurality of hangers 60 spaced at intervals along the length thereof. Each hanger 60 includes an upright, U-shaped lower portion 62 depending downwardly from a top portion 64. Each top portion 64 includes a pair of opposed, flanges 66, 66' extending horizontally-outwardly from upper ends 68, 68' of the U-shaped lower portion 62.

The hanger-supporting member 44 includes a plurality of downwardly-depressed hanger recesses 70, and includes a hanger opening 72 associated with each hanger recess 70. Each hanger recess 70 is preferably sized and shaped to substantially closely receive a top portion 64 of a hanger 60 disposed therein, with a lower portion 62 of the hanger extending through an associated hanger opening 72. Further, each hanger recess 70 preferably has a depth substantially equal to a thickness of the top portion 64 of the hanger 60, such that the top portion 64 of the hanger 60 is substantially flush with, or substantially co-planar to a top surface of the hanger-supporting member 44. Further, each hanger recess 70 has a pair of opposed, sloping sides 74, 74' to correctly and positively locate the hanger 60 within the recess 70. Each hanger opening 72 is preferably sized and shaped to closely receive the lower portion 62 extending therethrough.

The hanger-supporting member 44 is preferably affixed to the lower surface 46 of the upper rim 16 of the base 12 by a plurality of mechanical fasteners 76, such as screws, bolts, or the like, with each fastener 76 being directed through and engaging the upper rim 16, the top portion 64 of a hanger 60 and the hanger-supporting member 44. Thus, the top portions 64 of the hangers 60 are trapped intermediate the hanger-supporting member 44 and the upper rim 16 of the base 12 to positively and robustly mount the hanger-supporting member 44 and the hangers 60. This construction is a marked improvement over prior designs wherein the prior hangers are mounted below the prior hanger-supporting member by spot-welding, which requires multiple, independent mounting steps for each hanger and may produce unreliable results.

The locking bar 28 is directed through and suspended by the lower portions 62 of the hangers 60 below the hanger-supporting member 44 and is moved horizontally, between an unlocked and the locked position by manual or powered rotation of a locking bar articulation mechanism 78 accessible from an exterior of the casket at a first end 80 of the base 12. The locking bar articulation mechanism 78 is actuated by a removable crank 82 that engages a socket 84 in an exposed end of the articulation mechanism 78.

Preferably, the locking bar articulation mechanism 78 includes a screw 86 having a shaft 88, a threaded portion 90 and an axial constraint 92. As depicted, the axial constraint 92 may include an annular recess 91 having a cross-section with a diameter less than that of axially adjacent portions of the screw 86. However, the axial constraint 92 may include an annular flange (not shown) having an increased cross-section relative to such axially adjacent portions of the screw 86.

Figure 7:
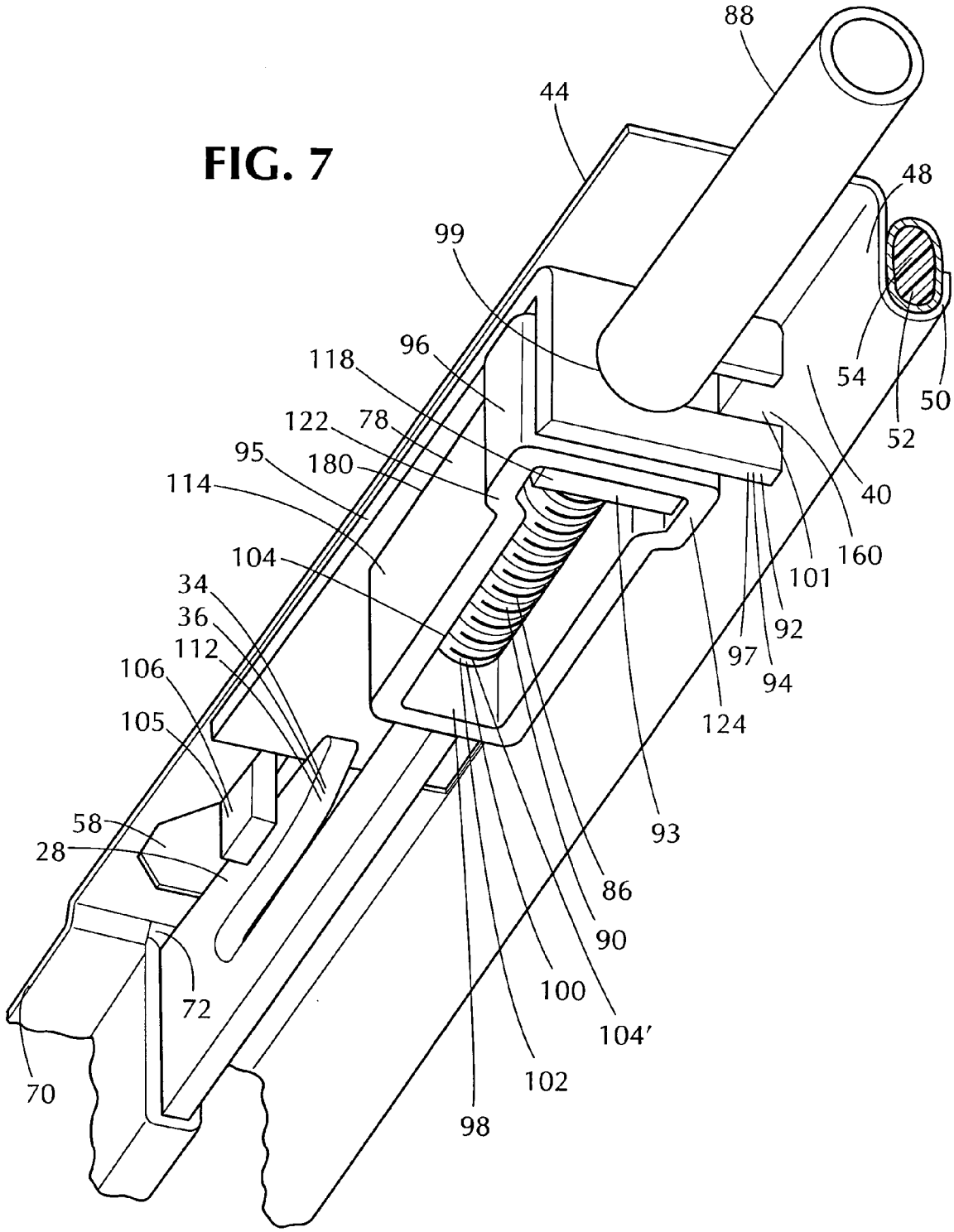

The articulation mechanism 78 also includes a collar 94 fixed relative to the base 12, which collar 94 engages the axial constraint 92 of the screw 86. The collar 94 and axial constraint 92 are operable to rotatably support and axially constrain the screw 86, relative to the base 12. Preferably, the collar 94 includes a horizontally-aligned slot 160 (FIG. 7) within a collar flange 97, which collar flange 97 is affixed to and depends downwardly from a bracket 95 attached to the lower surface 46 of the upper rim 16 of the base 12. As depicted, the collar flange 97 may be integrally formed from the bracket 95.

The slot 160 of the collar flange 97 is sized and shaped to closely receive the axial constraint 92 of the screw 86 and includes a closed end 99 and an open end 101 through which the axial constraint 92 of the screw 86 is inserted during assembly. Preferably, the open end 101 of the slot 160 is disposed adjacent the decorative material-supporting portion 48 of the elongated J-shaped channel 40.

In an alternate embodiment (FIGS. 2 and 6), the collar 94 has a vertically-aligned slot 160 having an open end 101 attached to the base 12.

A threaded nut 93 is disposed over the threaded portion 90 of the screw 86, and the locking bar 28 includes a nut-engaging portion 96 which substantially prevents rotation of the nut 93 relative to the screw 86 such that rotation of the screw 86 results in axial translation of the nut 93 relative to the screw 86. The nut-engaging portion 96 also substantially prevents axial translation of the nut 93 relative to the locking bar 28 such that axial translation of the nut 93, relative to the screw 86, results in a substantially equal axial translation of the locking bar 28.

During retraction of the locking bar 28, the locking bar 28 moves toward the first end 80 of the base 12. The locking bar 28 has a retracted (i.e., locked) position (see FIG. 7) wherein a retraction stop prevents further retraction of the locking bar. Such retraction stop can comprise a portion of the locking bar 28 which contacts the collar 94 or a portion of the screw 86.

Such retraction stop can alternatively comprise a retraction limiting portion 98 of the locking bar 28 that contacts a free end portion 100 of the threaded portion 90 of the screw 86. Preferably, in this alternate embodiment, when the locking bar 28 is in the retracted position, the retraction limiting portion 98 abuts an end face 102 of the free-end portion of the screw 86 and the retraction limiting portion 98 partially encircles the free-end 100 of the screw 86, such as the end face 102 and opposed lateral sides 104, 104' of the free-end portion 100. Thus, the free-end portion 100 of the screw 86 is reliably trapped within the retraction limiting portion 98 when the locking bar 28 is in the retracted position.

During extension of the locking bar 28, the locking bar 28 moves away from the first end 80 of the base 12. The locking bar 28 has an extended (i.e., unlocked) position wherein an extension stop 105 fixed relative to the base 12 engages the locking bar 28 to prevent further extension of the locking bar 28. Preferably, the extension stop 105 includes a pair of extension stop flanges 106, 108 affixed to and depending downwardly from the bracket 95. Preferably, there is a gap 110 between the extension stop flanges 106, 108, which gap 110 is sized and shaped to permit the passage of a first locking projection catch 112 therethrough during retraction of the locking bar 28. As depicted, the extension stop flanges 106, 108 may be integrally formed with the bracket 95.

The locking bar 28 includes an integral or substantially integral loop 114, which loop 114 encircles the nut 93 and the free-end portion 100 of the screw 86. The loop 114 includes a screw opening 116 through which the screw 86 extends, which screw opening is preferably formed by removing a portion of the material forming the loop 114. The screw opening 116 is sized and shaped to permit free, non-engaging passage of the threaded portion 90 of the screw 86 therethrough. Specifically, the screw opening 116 is preferably circular with a radius greater than a maximum radius of the threaded portion 90 of the screw 86.

Preferably, the nut-engaging portion 96 of the locking bar 28 is integrally formed from a portion of the loop 114 adjacent the screw opening 116. The nut-engaging portion 96 partially wraps around or, in other words, closely partially encircles the nut 93. Specifically, the nut-engaging portion 96 of the loop 114 includes a first integral portion 118 disposed closely adjacent a first axial side 120 of the nut 93, intermediate the first axial side 120 and the collar 94. The first integral portion 118 of the nut-engaging portion 96 is aligned substantially perpendicular to a direction of travel of the locking bar 28 and includes the aforementioned screw opening 116 to permit passage of the screw 86 therethrough.

Second and third integral portions 122, 124 of the nut-engaging portion 96 are disposed closely adjacent opposed lateral sides 126, 128 of the nut 93, and are aligned substantially parallel to the direction of travel of the locking bar 28. Fourth and fifth integral portions 130, 132 are disposed closely adjacent a second axial side 134 of the nut 93, on opposite sides of an axis of the screw 86 and are substantially parallel to said first integral portion 118. The first, fourth and fifth portions 118, 130, 132 of the nut-engaging portion 98 substantially prevent axial translation of the nut 93 relative to the locking bar 28. The second and third portions 122, 124 of the nut-engaging portion 96 substantially prevent rotation of the nut 93 relative to the screw 86. Thus, rotation of the screw 86 results in translation of the nut 93 and locking bar 28.

The first integral portion 118 of the loop 114 may comprise the retraction stop. Alternatively, the retraction limiting portion 98 of the locking bar 28 is preferably integrally formed from an interior surface 135 of the loop 114 which contacts the free-end portion 100 of the screw 86 (in one embodiment) when the locking bar 28 is in the retracted position. When the locking bar 28 is in the extended position, the extension stop 105 contacts an exterior surface 139 of the portion of the loop 114 that forms the retraction limiting portion 98.

The loop 114 includes a pair of elongated side portions 136, 138 disposed on opposite horizontal sides of the axis of the screw 86, which elongated side portions 136, 138 interconnect the nut-engaging portion 98 and the retraction limiting portion 98. Each side portion 136, 138, and/or each of the second and third integral portions 122, 124, has a substantially linear, horizontal top edge 180 substantially abutting a horizontal guide plate 140 affixed to the base 12. Preferably, such guide plate 140 may be the support plate 95. The proximity of the top edges 180 to the guide substantially prevents rotation of the integral loop 114 relative to the axis of the screw 86. The horizontal guide plate 140 preferably interconnects the collar 94 and extension stop 105.

Preferably, the loop 114 is formed from an elongated length of material having a height (as measured vertically, when installed) substantially greater than the thickness thereof, and having a longitudinal axis parallel to the direction of travel of the locking bar, with a longitudinal length substantially greater than the height. The material is deformed (i.e., bent) about preferably ten (10) parallel axes, which axes are substantially perpendicular to the longitudinal axis, thereby forming the loop 114.

The loop 114 is substantially symmetrical about horizontal and vertical planes passing through the axis of the screw. A free end 142 thereof is welded, or otherwise rigidly affixed to an elongated base portion 144 of the locking bar 28. The base portion 144 preferably includes the first locking projection catch 112 integrally formed therein. The remaining locking projection catches are preferably integrally formed in an extension 146 of the locking bar 28, which extension 146 is rigidly affixed to the base portion 144, such as by screws, bolts, or a weld, or other rigid connection.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A burial casket, comprising:

a base portion having an upper rim with a front portion, said front portion of said upper rim having a plurality of locking element openings disposed along a length thereof;

a top connected to said base portion, said top having a closed position and having a lower rim with a front portion;

said top having a plurality of locking elements disposed along a length of said front portion of said lower rim, said locking elements depending downwardly from said lower rim;

said front portions of said upper and lower rims being in substantial abutting relationship when said top is in said closed position;

a hanger-supporting member affixed to a lower surface of said upper rim of said base, said hanger-supporting member having a plurality of locking element openings aligned with said locking element openings of said upper rim of said base;

a locking bar extending below said hanger-supporting member, said locking bar having a locked position and, said locking bar extending through and being supported by a plurality of hangers;

when said top is in said closed position each locking element extending through an associated one of said locking element openings of said upper rim of said base and through an associated one of said aligned locking element openings of said hanger-supporting member;

when said top is in said closed position and said locking bar is in said locked position, said locking bar engaging said plurality of locking elements to restrain said top in said closed position;

said hanger-supporting member having a plurality of downwardly-projecting hanger recesses disposed along a length thereof, each hanger recess having a hanger opening therethrough;

each hanger having a top portion and a lower portion, said lower portion depending downwardly from said top portion; and said top portion of each hanger being disposed in one of said hanger recesses and each lower portion extending through the associated hanger opening in said one hanger recess;

whereby said hanger recesses provide predetermined, positive locations for said hangers.

2. A burial casket as in claim 1, wherein each hanger recess is sized and shaped to closely receive one of said top portions of one of said hangers intermediate said hanger-supporting member and said upper rim of said base.

3. A burial casket as in claim 1, wherein each hanger recess has a depth substantially equal to a vertical thickness of the top portion of the hanger disposed therein.

4. A burial casket as in claim 1, wherein each hanger recess has a pair of opposing, sloping sides to locate the hanger disposed therein.

5. A burial casket as in claim 1, wherein:

a decorative material-supporting member depends downwardly from said hanger-supporting member.

6. A burial casket as in claim 1, further comprising a plurality of fasteners directed through said upper rim of said base, said fasteners engaging said hanger-supporting member and said top portions of said hangers, to affix said hanger-supporting member and said hangers to said base.

7. A burial casket as in claim 1, wherein:

each hanger recess is sized and shaped to closely receive one of said top portions of one of said hangers intermediate said hanger-supporting member and said upper rim of said base;

each hanger recess has a depth substantially equal to a vertical thickness of the top portion of the hanger disposed therein; and each hanger recess has a pair of opposing, sloping sides to locate the hanger disposed therein.

8. A burial casket, comprising:

a base portion;

a top connected to said base portion, said top having a closed position having a plurality of locking elements;

a locking bar having locked and unlocked positions;

when said top is in said closed position and said locking bar is in said locked position, said locking bar engaging said plurality of locking elements to restrain said top in said closed position;

a locking bar articulation mechanism having a screw, said screw having a shaft, a threaded portion and an axial constraint;

a collar affixed to said base, said collar engaging said axial constraint of said screw, said collar being operable to rotatably support and axially constrain said screw relative to said base;

a nut threaded on said threaded portion of said screw;

said locking bar having an integral loop portion partially closely encircling said nut;

said threaded portion of said screw extending through a hole in said integral loop, said hole being sized and shaped to permit non-engaging passage of said threaded portion of said screw therethrough;

said integral loop substantially preventing rotation and axial movement of said nut relative to said locking bar, such that rotation of said screw results in axial translation of said locking bar.

9. A casket as in claim 8, wherein said integral loop includes an integral nut-engaging portion which closely partially encircles said nut, said hole being located in said nut-engaging portion.

10. A casket as in claim 9, wherein said nut-engaging portion includes a first integral portion disposed closely adjacent a first axial side of said nut, intermediate said first axial side and said collar, said hole being located in said first integral side;

said nut-engaging portion includes second and third integral portions disposed closely adjacent opposed, lateral sides of said nut;

said nut-engaging portion includes fourth and fifth integral portions disposed closely adjacent a second axial side of said nut on opposite sides of an axis of said screw.

11. A casket as in claim 10, wherein:

said integral loop portion of said locking bar has a pair of substantially linear, horizontal top edges disposed on opposed horizontal sides of said axis of said screw; and each top edge substantially abutting a horizontal guide affixed to said base;

whereby a proximity of said top edges to said guide substantially prevents rotation of said integral loop relative to said axis of said screw.

* * * * *